United States Patent [19]

McCall

[11] 4,168,028

[45] Sep. 18, 1979

[54] SHIPPING BOX FOR COATS

[75] Inventor: Richard J. McCall, Chicago, Ill.

[73] Assignee: Mack-Chicago Corporation, Chicago, Ill.

[21] Appl. No.: 907,676

[22] Filed: May 19, 1978

[51] Int. Cl.[2] ..... B65D 5/22; B65D 5/30

[52] U.S. Cl. ..... 229/34 R; 229/36

[58] Field of Search ..... 229/34 R, 36

[56] References Cited

U.S. PATENT DOCUMENTS

| | | | |
|---|---|---|---|
| 1,149,891 | 8/1915 | Billstein | 229/34 R X |
| 2,128,342 | 8/1938 | Zalkind | 229/34 R |
| 2,319,919 | 5/1943 | Clark | 229/34 R X |
| 2,843,307 | 7/1958 | Goltz | 229/34 R |
| 2,965,279 | 12/1960 | Campbell | 229/34 R |
| 2,990,995 | 7/1961 | Wessell | 229/34 R |
| 3,112,058 | 11/1963 | Martin | 229/36 |
| 3,826,420 | 7/1974 | Bamburg | 229/36 |
| 3,889,868 | 6/1975 | Bruckner et al. | 229/34 R |

FOREIGN PATENT DOCUMENTS

| | | | |
|---|---|---|---|
| 853102 | 2/1962 | France | 229/34 R |

*Primary Examiner*—Davis T. Moorhead

*Attorney, Agent, or Firm*—Hill, Van Santen, Steadman, Chiara & Simpson

[57] ABSTRACT

A large box of sufficient size to carry a coat is cut and folded with the use of a conventionally sized standard die from a single piece of sheet-form material and has side panel structures formed by having an exterior side panel, an integral hinge, and an interior side panel with latching tabs to interlock with the bottom of the box. The exterior and interior side panels have a reduced total height due to the hinged side panels being formed with a bias cut so as to reduce the effective height of the panels to be less than the total height of the completed box while still providing closure integrity and structural stability.

3 Claims, 8 Drawing Figures

SHIPPING BOX FOR COATS

BACKGROUND OF THE INVENTION

1. Field of the Invention

The invention relates to the field of cardboard boxes assembled from preformed flat sheet blanks.

2. The Prior Art

The prior art is represented by applicant's prior U.S. Pat. No. 2,953,292 entitled "CHIPBOARD BOX", wherein is disclosed a box assembled from a flat sheet blank scored and cut to provide end flaps and a folding top. In applicant's U.S. Pat. No. 2,942,768 there is disclosed a box constructed from a single piece sheet form blank having five sections defined on precut blank with a body section supporting a set of end flaps each of which contain three panels. Of the three panels associated with each of the two end flaps, the center panel forms the exterior side wall of the completed box, the top panel having a tucker is hinged to the fold exterior side wall and lies adjacent to a panel integrally affixed to the front of the box when the front of the box has been brought adjacent to the side panels. The flap associated with each side of the front of the box is tucked between the exterior side panel and the top panel having the tucker. The tucker on each top panel of each side flap locks into the bottom panel of each side flap which has been folded into the bottom of the box.

Because of the size capacity limitations of the dies used in forming the structure of the side flaps associated with the rear of the box as in the case of U.S. Pat. No. 2,942,768 or as associated with the front of the box as is the case with U.S. Pat. No. 2,953,292 it is difficult to produce a relatively large box. As the depth of the box increases, the size of the sheet blank must be correspondingly increased. As a result, when the required sheet length size for a box of a given depth exceeds the standard available die size, it cannot be made on a standard die set-up.

The box of the present invention is of sufficient size to carry a coat i.e. approximately 14×24 inches, but can be made on a standard die of 39×43 inches.

SUMMARY OF THE INVENTION

A single piece of appropriately cut and shaped sheet stock is scored to provide a front, bottom, rear, top and front panel. The sides are formed having an exterior and interior side panel with an integral hinge and being affixed to the bottom of the box along a further score line. Each of the exterior side panels affixed to the bottom of the box has its apparent height reduced because the integral hinge affixing it to the internal side panel is, by means of biasing cuts, affixed to the top of the interior side panel along a line closer to the score line between the bottom of the box and the exterior side panel than corresponds to the actual overall height of the box. The internal side panel is correspondingly shortened and allows tabs affixed thereto to interlock with slots in the bottom of the box. Thus, a box is produced which has a greater effective height, when assembled, which has complete closure integrity and structural stability and which can still be made upon a standard sized forming die, than would be possible were the effective height of the external side panels not reduced by means of bias cuts.

The front panel of the top of the box is held against the front of the box by a pair of side tabs which slide between the exterior side panel and interior tab affixed to the front of the box. The side tabs because of the reduced effective height of the external side panels of the box are also cut back on a bias line resulting in reduced side front tabs which provide the latching function. A front tucker then holds the front flap closed against the front of the box.

DESCRIPTION OF THE PREFERRED EMBODIMENT

While the principles of the present invention find a particular utility in a one-piece cardboard box, it will be understood that the arrangement of the present invention may be utilized in other combinations. By way of exemplary disclosure of the best mode of practicing the invention there is shown generally in FIG. 1 a perspective view of a sheet 10 cut and partly folded to form the box of the present invention.

Figures 1, 2, 3, 8:
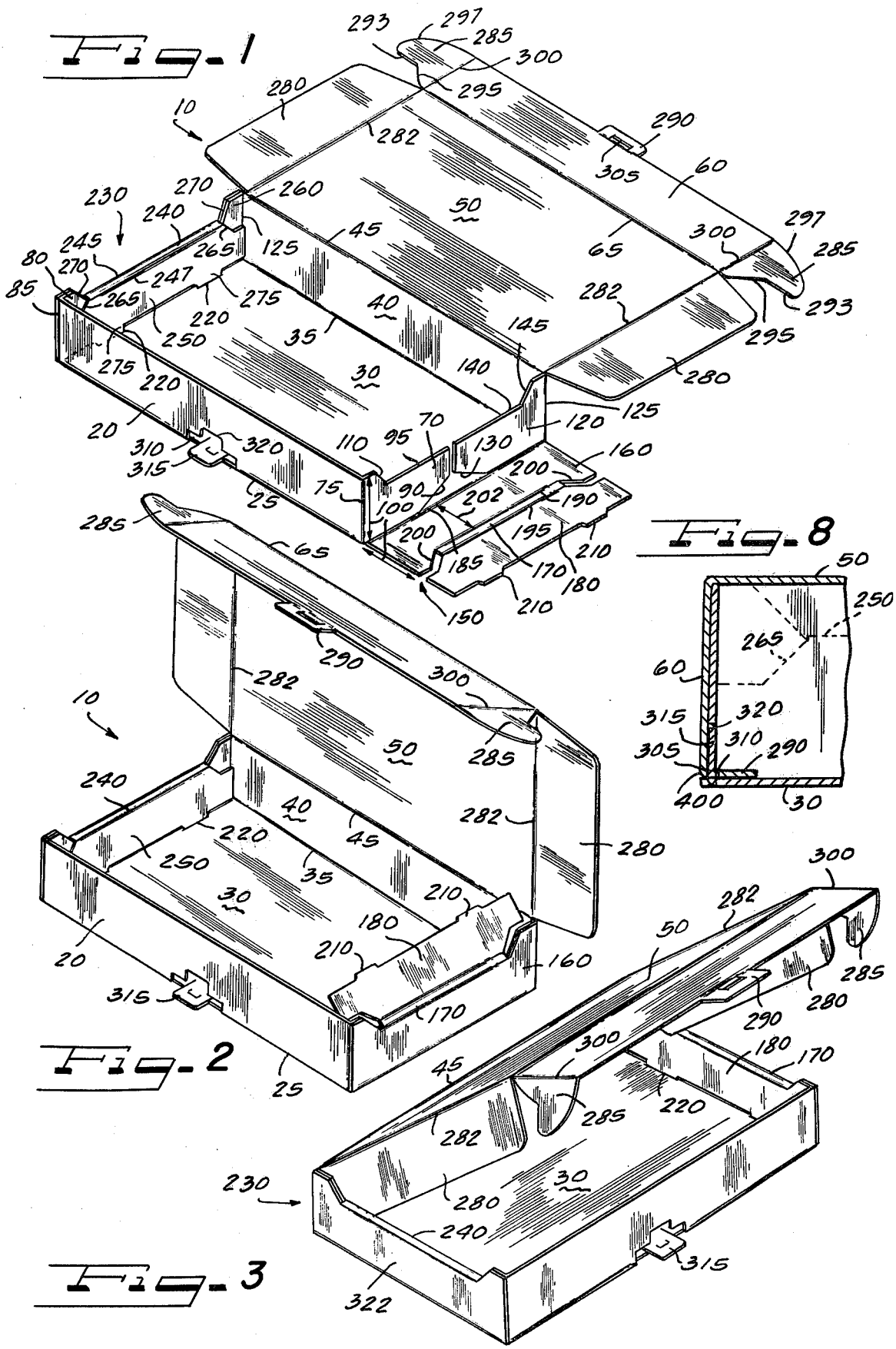
FIG. 1 is a perspective view of a sheet form blank shaped according to the principles of the present invention partially assembled.
FIG. 2 is a perspective view of the sheet form blank of FIG. 1 at a further state of assembly.
FIG. 3 is a perspective view of the sheet form blank shaped according to the present invention with the box portion itself fully assembled.
FIG. 8 is a fragmentary cross-sectional view taken along line VIII—VIII of FIG. 4 showing details of the structure of the latching tucker.

As will be noted from FIG. 1 the sheet-form member 10 is composed of a single piece of appropriate weight board material scored and cut so as to be foldable into a closed box. A front panel 20 is formed by providing a score line 25 in the sheet form member 10. A body member 30 is provided by forming a second score line 35 in the sheet form member 10. The score lines 25 and 35 are in parallel spaced relation with respect to one another.

A rear wall or panel 40 is formed by providing a third score line 45 in spaced parallel relation to the score lines 25 and 35. A top wall or panel 50 is defined having a front portion 60 by providing a score line 65 also in spaced parallel relation to the score lines 25, 35 and 45. The front panel 20 has a first tab 70 along one edge thereof and separated therefrom by a score line 75 disposed perpendicularly to the score line 25.

A second tab 80 is formed by providing a score line 85 also perpendicularly disposed to the score line 25. The tab 70 has a front side 90 cut on a bias with respect to the score line 25 for ease of assembly. The tab 80 has a similar bias cut.

It is an important feature of this invention that the flap 70 has a notch 95 formed therein extending inwardly of the flap along a second bias 110. Thus, the apparent height of the notch 95 is less than the height 100 of the tab 70 at score line 75.

A flat 120 is formed with respect to the rear 40 of the box by providing a score line 125 perpendicularly disposed to the score lines 35 and 45 at the opposite edges of the rear wall or panel 40 of the box. The flap 120 has a bias cut 130 at the front corresponding to the bias cut 90 of the flap 70 to enhance ease of assembly. In accordance with this invention, the flap 120 also has a notch 140 extending into the flap 120. The flap 120 resumes its full height where it joins the rear of the box 40 at the crease 125 by means of a bias cut 145.

Cooperating with the notched flaps 70 and 120 is a two part end flap shown generally at 150 and comprising an inner section 160, an integral hinge 170 and a second outer section 180. An end flap score line 185 is provided perpendicular to the score lines 25 and 35 which permits the end flap 150 to hinge and fold relative to the bottom panel 30 of the box 10. The hinge 170 is formed by a pair of closely spaced score lines 190 and 195 parallel to and spaced from the end flap score line 185.

It is an important feature of the invention that the panels 160 and 180 have their effective height reduced by providing the score line 190 and a pair of bias cuts 200. The effect of the bias cuts 200 in reducing the effective height of the panels 160 and 180 which together form the side walls of the box 10 when assembly is complete, is to make the panels 160 and 180 correspond in shape to the two previously defined flaps 70 and 120. Thus, the panels 160 and 180 have the full height 100 of the box at each end corresponding to the length of score lines 75 and 125 adjacent an end of the front panel 20 and the rear wall 40 respectively but have a reduced height 202 in a central region due to the bias cuts 200.

In order for the box 10 to securely lock together and be rigid when assembled, a pair of tabs 210 are provided on the end of the panel 180 for operatively engaging a corresponding pair of slots 220 formed in the bottom wall 30 of the box.

Because of the reduced effective height of the end wall construction a larger box may be produced off of a standard die than would be possible than if the end flap 150 merely had a simple straight hinge 170 of the type disclosed in my prior patent. Yet, the full depth of the box is not compromised. Because of the fact that the bias cuts 200, 110, and 145 form reentrant notches in the flaps 70, 120, the side panels 160 and 180 afford full height 100 at the side of the box 10.

The body 30 has a second end flap structure 230 defined thereon which is identical in structure to the end flap 150 as previously discussed which forms the other side of the box 10.

FIG. 1 discloses the end flap structure 230 in its assembled condition with a hinge 240 defined by a score line 245 and a score line 247 with an interior flap 250 folded over the flap 80 affixed to the front panel 20 and a flap 260 affixed to the rear panel 40. The folded interior flap 250 has a pair of bias cuts 265 which correspond to a pair of bias cuts 270 in the flaps 80 and 260, respectively. The interior flap 250 also has a pair of tabs 270 which cooperate to interlock with the slots 220 in the base 30 of the box. The interconnecting tabs 275 lock the hinge 240 in the place and give the side of the box structural stability.

The top 50 of the box 10 has a pair of full size side panels 280 which upon closing the top 50 are folded along a pair of score lines 282 and fit within the closed interior of the box 10 adjacent to the interior side panels 250 and 180 to provide adequate closure protection to the interior contents of the box. The front 60 of the top 50 of the box also has a pair of closure tabs 285 and a tucker 290. The tabs 285 are cut back along a pair of bias lines 293 and 295 and have a curved front structure 297. The tabs 285 are foldable at a score line 300 with respect to the front 60. The tucker 290 has a centered slit 305. Along the front panel 20 of the box 10 is found a slit 310 corresponding in length and height to the tucker 290, a latching tab 315 and an interlocking slit 320 for the latching tab 315.

FIG. 2 illustrates the box 10 in a further state of completion. The interior side panel 180 is shown with the hinge 170 partially flexed, and with the exterior side panel 160 positioned adjacent to the flaps 95 and 120 affixed to the front 20 and the rear 40 of the box 10. Each of the side panels 280 of the top 50 of the box 10 is foldable along the score line 282 so that the side panels 280 may be brought into alignment with and adjacent to the two interior side panels 180 and 250.

FIG. 3 shows the box in a further condition of assembly with the side panels 280 of the top 50 having been brought adjacent to the interior side panels 250 and 180 as the top is being closed. As can be seen, the side panels 280 are folded along the score lines 282 with respect to the top 50. The tabs 285 affixed to the front flap 60 of the top 50 are also indicated being folded along the score lines 300 in order that the top 50 of the box 10 can be assembled with respect to the bottom 30 of the box. The end flap 230 has an exterior panel 322 as can be seen in FIG. 3.

Figure 4:
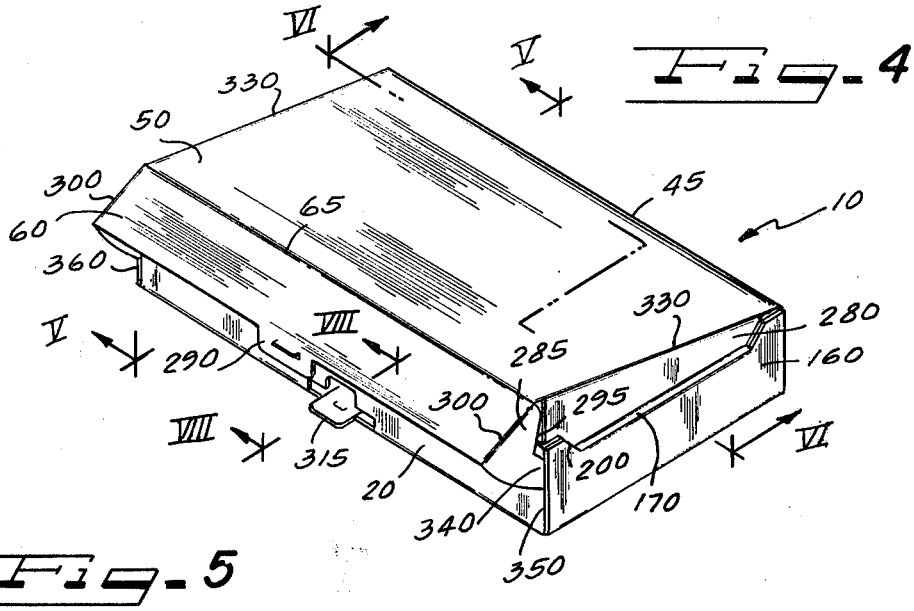
FIG. 4 is a perspective view of the box with the lid being partially engaged.

FIG. 4 shows the box 10 with the top 50 almost completely closed. Closure is accomplished by positioning the side panels 280 of the top 50 adjacent to the two interior panels 180 and 250. The front panel 60 of the top 50 is closed along the score line 65 by inserting a front region 340 of each of the tabs 285 into a slot 350 existing between the folded exterior side panel 160 and the interior front flap 70 affixed to the front 20 of the bottom 30 along the crease line 75. A second slot 360 is available at the other end of the box 10 formed by the adjacent interior flap 80 affixed to the front of the box 20 along the crease line 85 and the external side panel 322 corresponding to the side panel 160.

Figure 5:
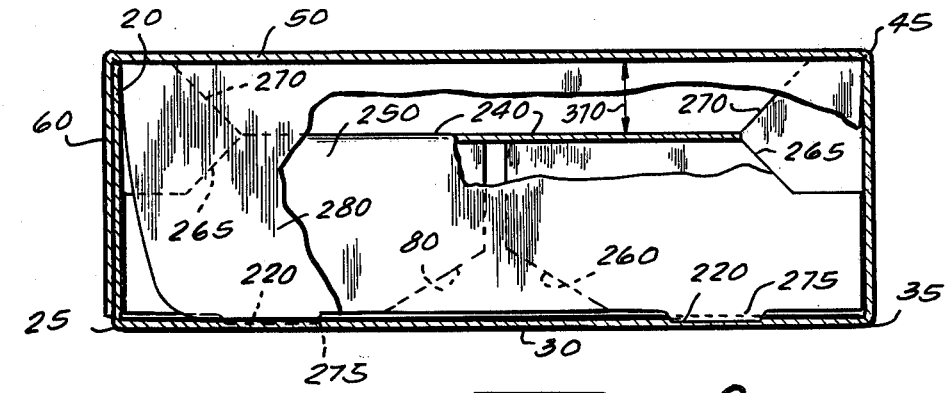
FIG. 5 is a cross-sectional sectional view taken along line V—V of FIG. 4 with parts broken away to show the interior structure of the folded box.

FIG. 5, a fragmentary section taken along line V—V, discloses the interrelationship between the tabs 80 and 260 affixed to the front 20 and the rear 40 of the box 10, respectively, with respect to the folded interior side panel 250 affixed by the hinge 240 to the end flap 230. The tabs 275 are indicated interlocking with the slots 220 providing structural stability to the entire box. The bias cuts 270 which allow the sides of the box to have the reduced height 202 while not reducing the effective overall height 100 of the box 10 are shown. FIG. 5 clearly indicates that the side panels 280 affixed to the top 50 of the box fill in a region 370 closing the end of the box 10 which is not closed by the end flaps 230 or 150.

Figure 6:
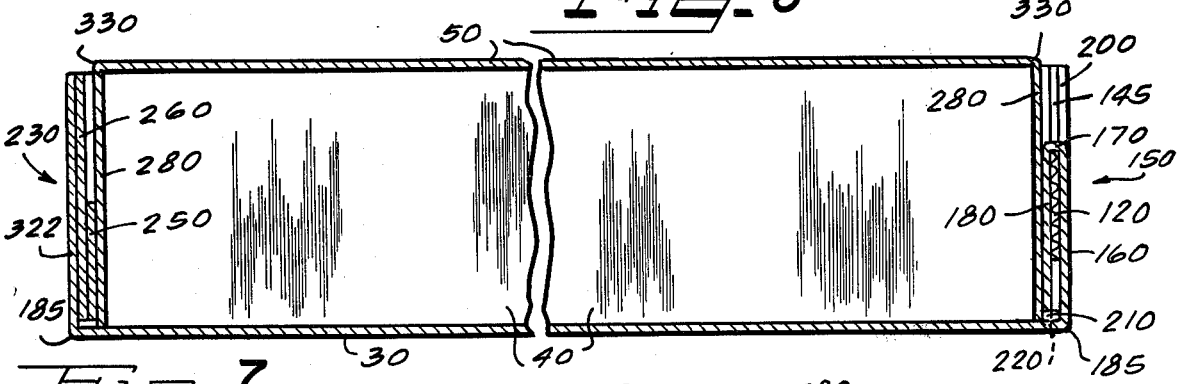
FIG. 6 is a cross-sectional view taken along line VI—VI of FIG. 4.

FIG. 6, a sectional view taken along line VI—VI illustrates the interrelationship between the two end flaps 150 and 230 and the top 50 and bottom 30 of the box 10. As is indicated, the hinge 170 of the end flap 150 enables the exterior side panel 160 along with the interior side panel 180 to contain the tab 120 affixed to the rear 40 of the box at the score line 125. Further, the tab 210 which is affixed to the interior side panel 180 is shown positioned in the slit 220 to lock the end flap 150 into position around the flap 120. The side panel 280 affixed to the top 50 along the score line 330 is also indicated adjacent to the interior side panel 180 and the corresponding second interior side panel 250.

Figure 7:
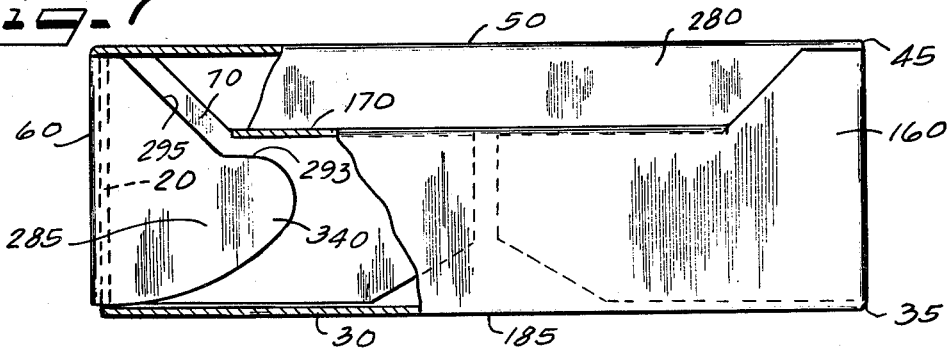
FIG. 7 is an elevated end view with parts broken away to show additional details of construction.

FIG. 7, an end view of the box 10, illustrates the relationship of the side walls provided by the panels 280 and 160, 180. The tabs 285 are affixed to the front panel 60 of the top 40. As can be seen in FIG. 7, the side tab 285 affixed to the front panel 60 of the top 50 has a front region 340 which slides in between and is adjacent to the exterior side panel 160 and the tab 70 affixed to the front 20 of the box 10 along the score line 75. As illustrated in FIG. 7, the front 340 of the flap 285 can extend into the reduced height central region 202 because of the cut-back region 293. Thus, the top 50 may be locked closed.

Referring to FIG. 8, the details of the tucker 290 latching the top 50 of the box 10 closed can be seen. The tucker 290 affixed to the front panel 60 of the top 50 passes through the slot 310 in the front panel 20, and has a score line 400 resulting in the tucker 290 ending up perpendicular to the front flap 60 of the top 50. Further, the latching tab 315 passes through the slit 305 in the tucker 290 and resides in the recessed opening 320 of the front 20 of the box 10.

A box utilizing the principles of the present invention produced on a standard die 39×43 inches has an assembled size of 23 and 13/16 inches×14 inches×4 inches.

Althought various modifications might be suggested by those skilled in the art, it should be understood that I wish to embody within the scope of the patent warrented hereon all such modifications as reasonably and properly come within the scope of my contribution to the art.

I claim as my invention:

1. In a shipping box for coats cut and folded from a single piece of bendable sheet-form material with a conventionally sized standard die comprising top, bottom, front and rear panels foldable to form a closed box, the improvement of flaps hingedly connected on said front and rear panels and having bias cuts forming reentrant notches therein which reduce the effective height thereof in the middle portions of the flaps when folded inwardly at the opposite sides of the box, side panel structures at opposite sides of said bottom each having an exterior side panel, an integral hinge, and an interior side panel with latching tabs to interlock with the adjoining bottom wall of the box, said exterior and interior side panels being particularly characterized by having their effective assembled height reduced by providing therebetween at the opposite ends a pair of bias cuts with said integral hinge extending through a center portion between said bias cuts, thereby matching the notched configuration of said flaps, said side panel structures adapted to be folded and locked over said flaps, and a full sized side panel hingedly connected on each end of said top panel and adapted to fit within the closed interior of the box adjacent said interior side panel when assembled to provide adequate closure protection for the interior contents of said box.

2. A box comprising:

a piece of sheet stock having a size and shape capable of being worked in a standard-size die;

an elongated rectangular front panel of selected length having a height defined by the distance between a first edge of said piece of sheet stock and a first score line thereon parallel to said edge;

a rectangular body member having a length substantially equal to said length of said front panel and located on said piece of sheet stock between said first score line and a second parallel score line located in spaced relation thereto;

a first and a second end flap score line located at a first and a second end of said body member and substantially perpendicular to said first and second score line;

an elongated rectangular rear wall adjacent said second score line, having a length substantially equal to said length of said front panel and a height, defined by a third score line parallel to said second score line, substantially equal to said height of said front panel;

a first and a second two-part end flap affixed to said body member at said first and second end flap score lines respectively, each said two-part end flap comprising an elongated outer section and an elongated inner section;

each said elongated inner section having a first edge coextensive with said respective end flap score line with the length of each said elongated inner section being substantially equal to said width of said body member;

each said elongated inner section having a height, in an end region adjacent said front panel and said rear wall substantially equal to said height of said front panel and said rear wall;

an integral hinge, shorter than said length of said inner section, located in spaced relation to said respective end flap score line, centered between said two end regions of said inner section, and operable to hingedly connect said inner section to said outer section whereby the height of said inner section between said two end regions is less than said height of said end regions;

a plurality of flaps, one member of said plurality being attached at a score line to each end of said front panel and said rear wall, whereby if said front panel and said rear wall are folded perpendicular to said body member, along said first and second score lines, each said inner section may also be folded perpendicular to said body member and adjacent a pair of said flaps, one flap connected to said front panel and one flap connected to said rear wall, and each said outer section may be folded over the top of each member to said respective pair of flaps and locked to said body member adjacent to said two flaps thereby forming an assembled box.

3. The box according to claim 2 having further a top hingedly affixed at said third score line with a pair of foldable side panels each having a height substantially equal to said height of said front panel, said top having a front portion foldable along a further score line, parallel to said third score line, with a first and a second closure tab located at each end thereof whereby said top is closable with each said member of said pair of foldable side panels being located perpendicular to said top and, adjacent a said outer section of said two-part end flaps thereby completely closing the assembled box;

said closure tabs each having a curved front with a cutback region adjacent thereto corresponding to said reduced height of said central region of each of said inner sections of each of said two-part end flaps;

whereby said top is locked closed by each of said two closure tabs being slidingly located in a region between said inner section and said outer section of a respective one of said pair of two-part end flaps and extending adjacent to said reduced height central region of each said respective inner section.

* * * * *